250-506.1 5R

OR 4,219,735

United Sta

Blum 4,219,735

Aug. 26, 1980

[54] CONTAINER
OF IRRADIA
HANDLING DEVICE ADAPTED THEREFOR

[75] Inventor: Paul Blum, Saint-Nom-la-Breteche, France

[73] Assignee: Transnucleaire, Societe pour les Transports de l'Industrie Nucleaire, Paris, France

[21] Appl. No.: 753,904

[22] Filed: Dec. 23, 1976

[30] Foreign Application Priority Data

Dec. 31, 1975 [FR] France ..... 75 40347

[51] Int. Cl.[2] ..... G21F 5/00

[52] U.S. Cl. ..... 250/507; 250/506; 250/518

[58] Field of Search ..... 250/506, 507, 515, 518; 176/30, 87, 36 R

[56] References Cited

U.S. PATENT DOCUMENTS 2,904,487 9/1959 Dickson ..... 250/518 ry ..... 250/507 l. ..... 250/507

3,859,555 1/1975 Savanic ..... 250/507

4,034,227 7/1977 Soot ..... 250/518

*Primary Examiner*—Bruce C. Anderson

*Attorney, Agent, or Firm*—Stevens, Davis, Miller & Mosher

[57] ABSTRACT

A container is described for the transportation of irradiated fuel elements whose criticality can be controlled by means of internally disposed neutron poison needles, wherein said container comprises, parallel to the compartments intended for the fuel elements, at least as many compartments as needles necessary for the fuel elements to be transported, these compartments being constructed such that not only can neutron poison needles be housed therein, but can also be easily introduced and extracted after removal of the lid of the container, these compartments being arranged in the body of the container or in its internal basket with dispositions such that the shielding characteristics are not affected.

4 Claims, 7 Drawing Figures

CONTAINER FOR THE TRANSPORTATION OF IRRADIATED FUEL ELEMENTS AND HANDLING DEVICE ADAPTED THEREFOR

The invention relates to a container for the transportation of irradiated fuel elements of the type whose criticality can be controlled by means of internally disposed neutron poison needles; these fuel elements are particularly those of the type generally known by the abbreviation PWR, from the English "pressurised water reactor".

The invention also relates to a handling tool intended for use with the said container.

It is to be noted that the fuel elements of the type under consideration consist of bundles of needles of fuel material, preferably arranged parallel to one another in order to form an array of regular frequency.

Because of their characteristics, the control of the criticality of these fuel elements can be ensured by internally disposed neutron poison needles in these fuel elements. In order to provide for the internal disposition of these neutron poison needles, certain of the combustible material needles of which the element is constituted are replaced by tubes of which one of the ends is open to the exterior and in the interior of which can be placed neutron poison needles.

With regard to these, it is to be noted that they generally consist of a sheath of non-oxidisable steel or similar material enclosing a material which absorbs neutrons, such as for example boron, gadolinium, indium, hafnium and others particularly in the form of alloys, fritted powders or glasses; the needles can also be solid.

It is understood that the control of the criticality of the fuel elements of this type must be ensured not only while the elements are in the reactor, but also during their transportation, for example, towards the reprocessing factory.

The control of the criticality of fuel elements during the transportation inside containers has been ensured up until now by means of neutron poisons arranged at the periphery of various compartments or housings for fuel elements, these neutron poisons being present in such a case for example in the form of sheets or removable needles arranged with a basket or embedded in the wall of the containers.

When the control of the criticality requires the insertion of neutron poison needles to the heart of the fuel elements as described above, there is a problem with handling and storage of these needles when returning the containers empty, this problem being made more acute because of the need to operate under water in a pool because of the intense radioactive contamination of the needles and the cavity of the container.

The invention has as an object, principally, to provide, as a solution to the above problem, a container and a handling tool for the neutron poison needles, both meeting the requirements of the technique.

Consequently, the container according to the invention is arranged in such a manner that it comprises parallel to the compartments intended for the fuel elements, at least as many compartments as needles necessary for the fuel elements to be transported, these compartments being characterised such that the neutron poison needles not only can be housed therein, but can also be easily introduced and removed after removal of the lid or cover of the container, these compartments being arranged in the body of the container or in its internal basket in sites such that the shielding characteristics are not affected.

The handling tool intended to allow the positioning of the needles in the compartment housings provided in the container as well as in those provided in the fuel elements is characterised by the fact that it comprises on the one hand centering means allowing positioning thereof with respect to the axis of the compartments for needles provided in the container and in the fuel element and, on the other hand, appropriate gripping means for co-operation with the end of the neutron poison needle.

The invention also embraces other characteristics which are preferably used at the same time as those mentioned above and which will be more explicitly considered hereafter.

Moreover the invention will at any rate be better understood with the help of the following description, relating to advantageous embodiments as well as with the help of the corresponding drawings in which:

FIGS. 1 and 2 respectively represent in plan view and, on a bigger scale, in simplified section along II—II of FIG. 1, a container constructed in accordance with a first embodiment of the invention;

To construct a container for fuel elements and the corresponding control tool in accordance with the invention, one proceeds as follows or in an equivalent manner.

Figure 1:
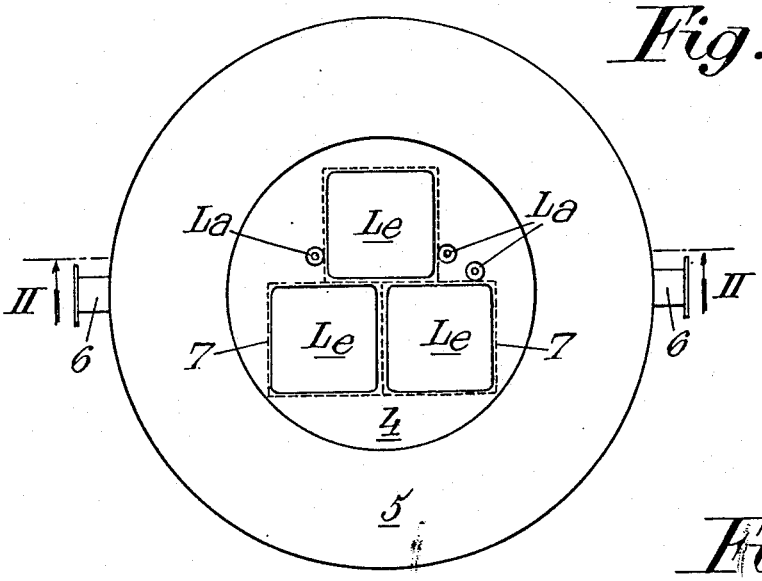
Figure 6:
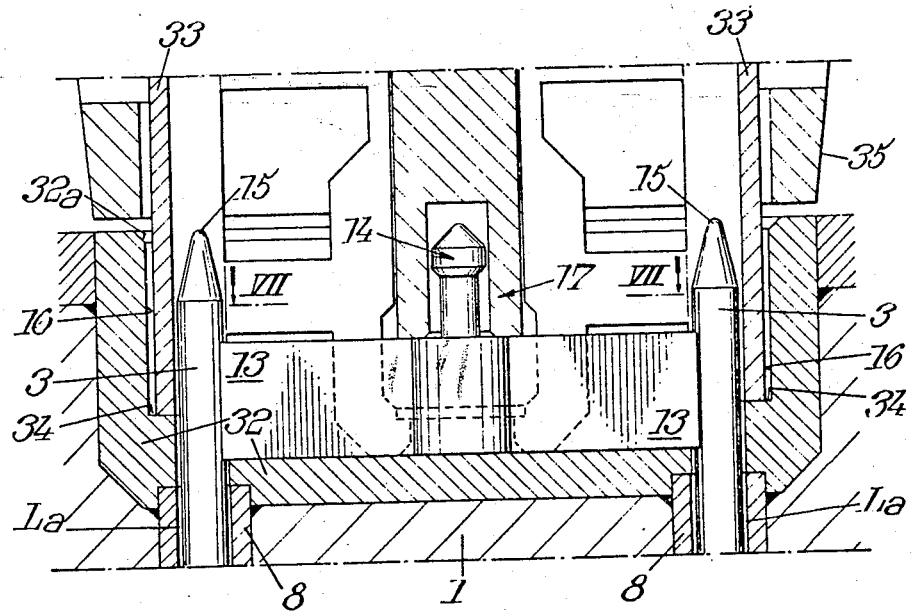
FIGS. 6 and 7 show, on a bigger scale, respectively in section along VI—VI of FIG. 7 and in plan view with partial sectioning along VII—VII of FIG. 6, a portion of a container according to the invention in accordance with a second embodiment and the handling tool adapted therefor.

Assuming that the container, showed as a whole in 1, be constructed in a manner such that, as shown in FIG. 1 with the lid removed, it comprises three compartments $L_e$ intended to re-receive fuel elements 2 not shown in this figure, this container will comprise as many compartments $L_a$—intended to each receive a needle 3 of neutron poison not shown in FIG. 1—as needles necessary for the totality of fuel elements to be transported, thus, in the case of FIG. 1, there are as many compartments $L_a$ as there are compartments $L_e$, each of the fuel elements which are to be transported in this container requiring the presence of a neutron poison needle arranged in its mass in order to control the criticality; in the case of the embodiment of FIG. 6 pairs of two compartments $L_a$ are provided for each compartment $L_e$, the fuel elements transported by this container each requiring, in order that their criticality be controlled, the presence of two neutron poison needles, when three or more needles are required for the control of the criticality of a fuel element, the container will have groups of three or more compartments $L_a$ for each compartment $L_e$.

In a general way, the disposition of the compartments $L_a$ is chosen in such a manner that the efficiency of the shielding is not affected.

In the case of the embodiments of FIGS. 1 and 6, the compartments $L_a$ are arranged in the anti-radiation shielding 4 provided in the interior of the structure 5 of the container schematically represented with its handling spindles 6, the compartments $L_a$ are moreover advantageously placed, at least in the case of the embodiments of FIGS. 1 and 6, in the vicinity of the conventional neutron poisons schematically represented by 7 and installed in a permanent manner in the container, these conventional poisons are generally in the form of slabs or needles arranged with the basket which is not shown or else with the wall of the compartments $L_e$.

The compartments $L_a$ are constructed in such a manner that the neutron poison needles can easily be introduced therein and extracted therefrom.

Figure 2:
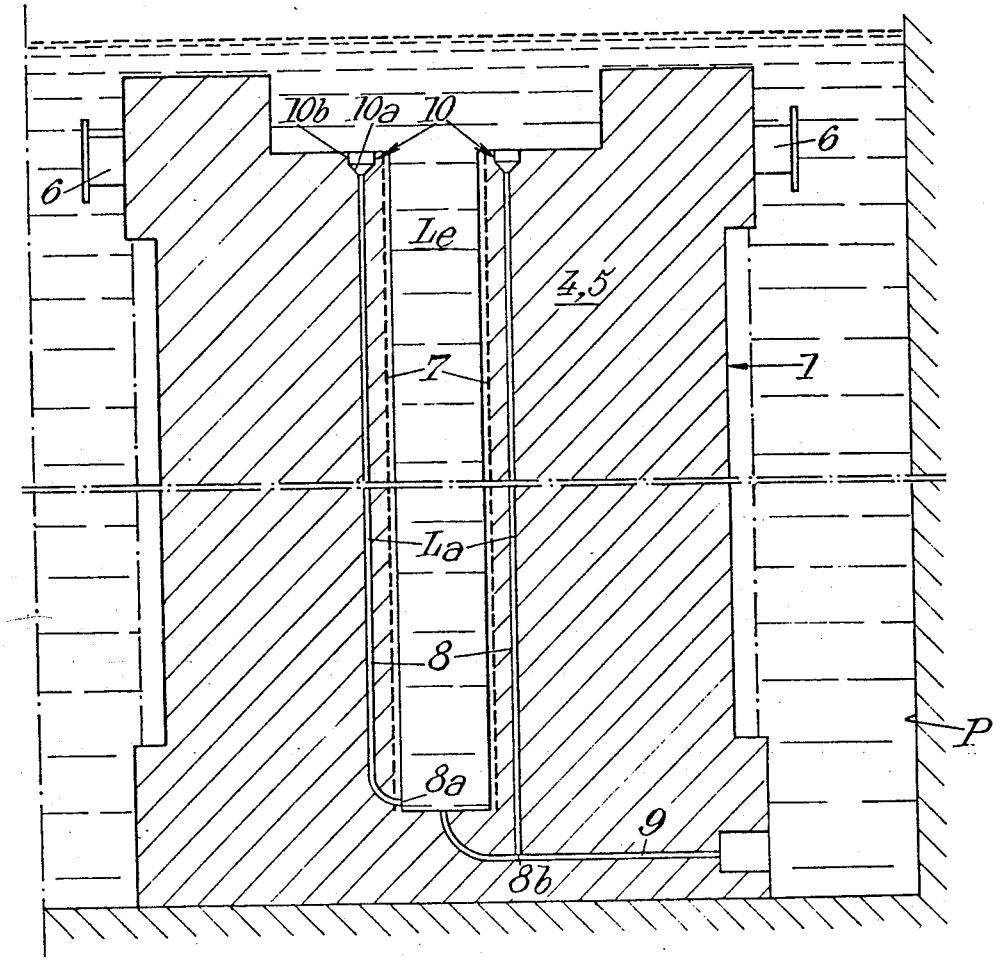
Figure 3:
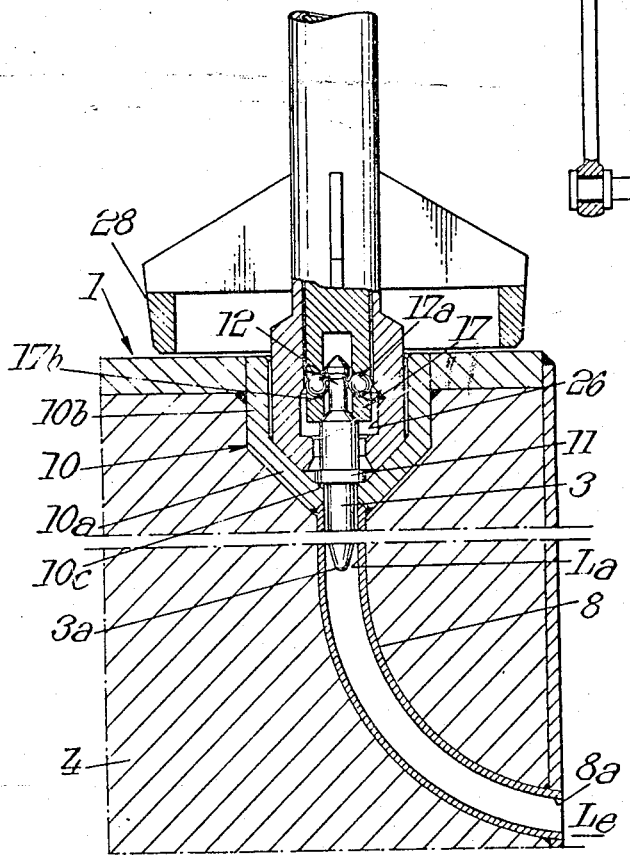
FIGS. 3 and 4 represent, in position respectively on the container and on a fuel element, sections of the handling or control tool of the invention corresponding to the embodiment of the container illustrated by the FIGS. 1 and 2.

Advantageously these compartments have the characteristics which are shown in the FIGS. 2, 3 and 4 or 6 and 7, each of the said compartments $L_a$ being preferably defined by a tube 8, for example of non-oxidisable steel, with its axis parallel to the axis of the container, one of the ends of the tube opening in the direction of the side of the container by which the fuel elements are introduced, the other end being either in communication by 8*a* with the bottom of a compartment $L_e$ as shown for example in FIGS. 2 and 3, or else in direct communication by 8*b* with a purging conduit 9 connected, to the bottom of a compartment $L_e$, also shown in the FIG. 2 in which the container is shown placed at the bottom of a filled pool P.

Figure 4:
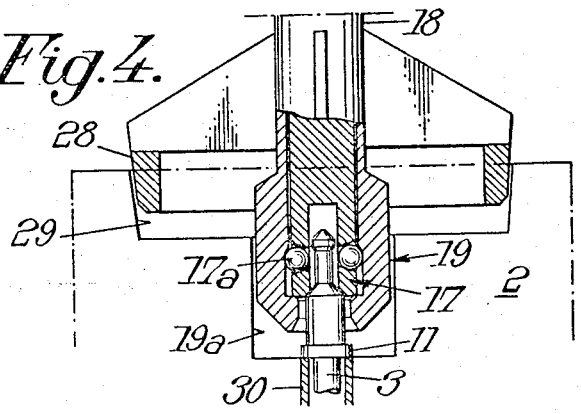

When a single neutron poison needle is provided for each fuel element, that is to say when for each compartment $L_e$ in the container there is provided one compartment $L_a$, or more generally when each needle must be individually manipulated in the handling operations, the above mentioned characteristics facilitating the extraction and insertion of needles 3 are advantageously those which appear on the embodiment shown by the FIGS. 2, 3 and 4. The end of the tube 8 which opens at the bottom of the housing of the lid of the container, communicates thus with the surface of the bottom by a mouthpiece 10 in the form of a funnel which facilitates the centering and which advantageously comprises a conical portion 10*a* and a cylindrical portion 10*b*.

Still in the embodiment of FIG. 3, it is on the bottom of the conical portion 10*a* which can be terminated in an edge 10*c* where the needle 3 rests when it is positioned in the compartment $L_a$, a positioning collar 11 of this needle abutting against the edge 10*c*.

The upper extremity of the needle comprises a gripping head 12 and the lower extremity comprises a rounded tip 3*a* which facilitates the insertion of the needle in the compartment $L_a$.

When the needle consists of a sheath filled with material which is the neutron poison, this sheath is closed at its two ends by plugs which thus form respectively the head 12 and the tip 3*a*.

When two or more neutron poison needles are provided for each fuel element, the container having then has as many groups of two or more compartments $L_a$ as there are compartments $L_e$, the insertion and extraction of these needles are advantageously facilitated by connecting the needles of each group by means comprising a common handling head.

Figure 7:
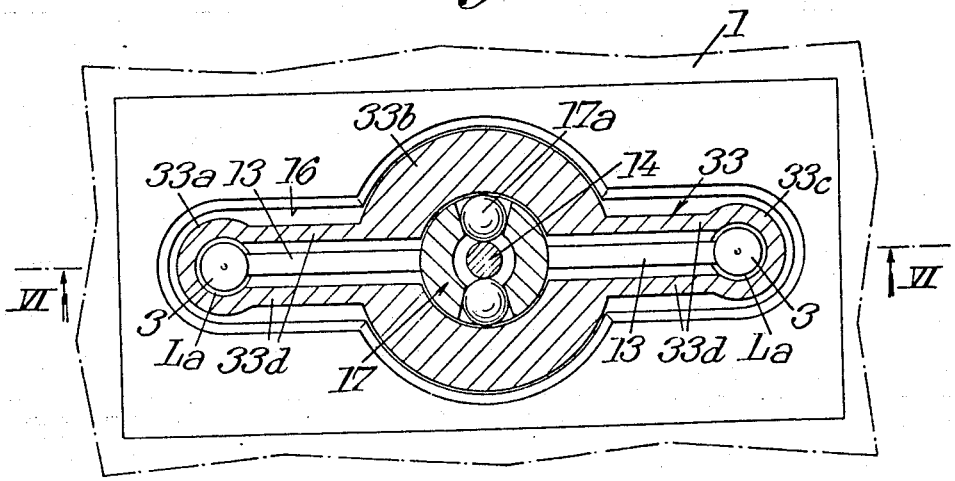

In the embodiment of FIGS. 6 and 7 which concerns groups of two needles 3 for each fuel element 2, the two needles of each group are rigidly joined one to the other by cross beams 13 which maintain them at a distance from each other equal to that between the axes of the two compartments $L_a$ of each group of compartments $L_a$.

The groups of two compartments $L_a$ are furthermore arranged in the same manner as in the preceding embodiment in such a way that the efficiency of the shielding is not affected, for example in the manner which follows from FIG. 1; one group of two compartments can then occupy approximately the position of the two single compartments provided in the upper quadrant to the right of FIG. 1.

The cross beams 13 comprise a handling head 14 equivalent to the head 12 of the preceding embodiment. The end corresponding to each needle can, in this case, be terminated by a rounded plug 15 similarly to the plug 3*a* provided in the preceding embodiment.

The tubes 8 in the case of the embodiment of FIGS. 6 and 7 open in the direction of the side by which is operated the loading of the container, in a cell 16 open on this side and whose configuration and dimensions are adapted to those of the handling tool of the invention, particularly to aid the centering.

The said handling tool can advantageously comprise, as shown in FIGS. 3, 4, 6 and 7, a gripping device of the ball-release type designated as a whole by 17, with balls 17*a* placed in housings 17*b* and able to cooperate with the head of tool 12 (or 14).

Figure 5:
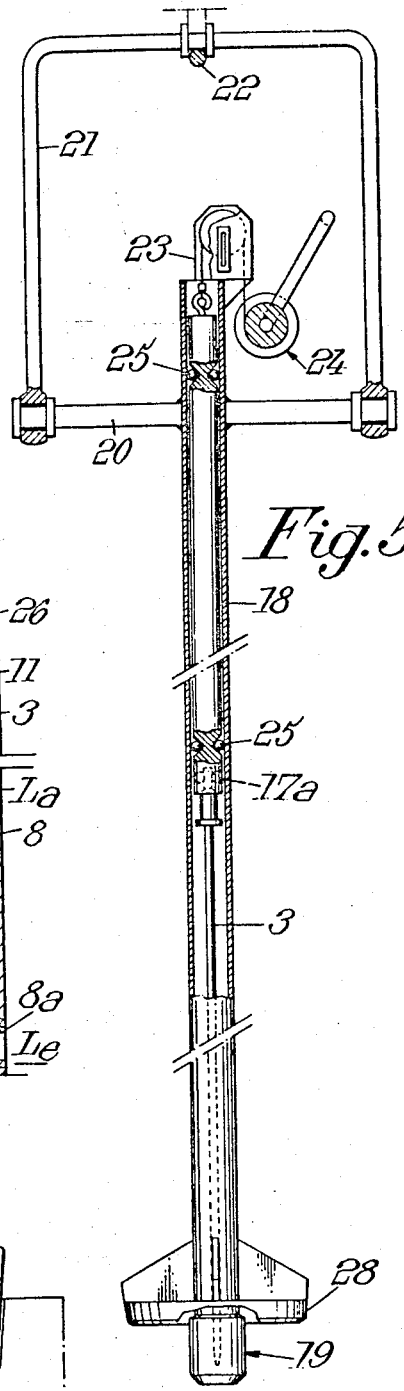
FIG. 5 shows in section on another scale the means co-operating with the handling tool.

In the case of the embodiment of the container illustrated by FIGS. 1, 2 and 3, the gripping device 17 is slidingly arranged inside a tube or sheath 18 shown in FIG. 5 and intended to receive a neutron poison needle during the handling, this tube 18 being terminated at one of its extremities by a tubular head 19 of external shape complementary to the ferrule or mouthpiece 10 provided at the extremity of each tube 8. The head 19 whose shape is thus adapted with a view to facilitate its insertion into the ferrule 10 and whose nature follows from FIGS. 2 and 3, comprises a space 26 by virtue of which is made possible the functioning of the ball release device, the conventional nature and functioning of which it is not necessary to refer to in detail. The second extremity of the tube 18 is open and carried by a support 20 joined by a swing bar 21 to a rolling bridge, not shown, by a hook 22. The device 17 slides in the interior of the tube 18 towards the bottom under the effect of its weight and towards the top under the effect of a suspension cable 23 joined to a winding winch marked as a whole by 24. Guiding and sliding of the device 17 in the interior of the tube 18 can be facilitated by groups of balls 25.

In FIG. 3 is shown the handling device in position in a ferrule 10, the needle 3 being at the point of being extracted from the tube 8 towards the interior of the sheath 18, the mode of operation of the gripping device clearly following from this figure.

As shown by the FIGS. 3, 4 and 5, the handling device provided at the lower extremity of the tube 18 comprises furthermore a centering element 28 of form complementary to centering means which is provided on the fuel element with a view to its manipulation and which, in the case of the embodiment shown in FIG. 4, consist of recesses 29 provided in its surface; in FIG. 4, the handling implement is seen in position on a fuel element 2, the centering element 28 being engaged in the corresponding recess 29, the head 19 in a corresponding housing 19*a* of the element 2 and the needle 3 in a tube 30 similar to tubes 8 of the container 1. In the position shown by FIG. 4, the needle 3 rests with its collar 11 on the end of the tube 30 and the handling device 17 has been lifted in its entirety, thus allowing release of the balls 17*a* in the hollow 26 and thus releasing the handling head 12.

In the case of the embodiment shown in FIGS. 6 and 7, the handling tool which is shown inserted in the cell 16 arranged at the bottom of the housing of the lid (not shown), still comprises a gripping device generally designated by 17, with ball release 17*a*, co-operating with the handling head 14 common to a group shown of two neutron poison needles 3. The cell 16 is defined by a part 32 with inclined edge 32*a* for facilitating the insertion of the handling tool, this latter comprising a tubular centering portion 33 (whose shape follows particularly from FIG. 7) which, at the time the gripping element 17 is engaged on the handling head 14, rests on an edge 34 carried by the portion 32. The portion 33 is in fact constituted by three tubes 33*a*, 33*b*, 33*c* joined together by cross beams 33*d* and slit to allow passage of the cross beams 13 when extracting needles 3 from their compartments $L_a$.

In a similar manner to that of the embodiment illustrated by FIGS. 3 to 5, the handling tool comprises once more a centering element 35 similar to the element 28 and intended to co-operate with the centering means provided on the fuel elements not shown.

The container for the transportation of irradiated fuel elements and the control or handling tool intended to be used with this container have numerous advantages, especially that of allowing not only the solving of the problem of storing of neutron poison needles intended for controlling criticality by internally disposing the neutron poison needed in the fuel element during the empty return of the container, but also that of the handling of the neutron poison needles during the operations in the pool.

I claim:

1. A container for the transportation of irradiated nuclear fuel elements whose criticality can be controlled by means of internally disposed neutron poison needles, wherein said container comprises first elongate compartments for housing said nuclear fuel elements therein during transportation and wherein said container is further provided with a number of neutron poison needles having gripping heads which are necessary to control the criticality of transported nuclear fuel elements by insertion of said needles inside said fuel elements, said container further comprising second elongate compartments, the number of which corresponds to said number of needles and inside which said needles are housed when said container does not contain said nuclear fuel elements, said second elongate compartments being arranged to house individual needles in positions parallel to said first elongate compartments, and constructed such that said needles may be easily introduced and extracted therefrom.

2. A container according to claim 1 wherein said second elongate compartments are located with the anti-radiation shielding of said container such that the radiation shielding characteristics of the container are not affected.

3. A container according to claim 1 comprising an internal basket within which said first elongate compartments are located, and wherein said second elongate compartments are located within the body of said basket such that the radiation shielding characteristics of the container are not affected.

4. A container according to claim 1 wherein said second elongate containers each comprise a tube, one end of which terminates in a funnel shaped ferrule to facilitate insertion and removal of a neutron poison needle, and the other end of which is in communication with a first elongate compartment for a fuel element.

* * * * *